US009528781B2

(12) United States Patent
Ley

(10) Patent No.: US 9,528,781 B2
(45) Date of Patent: Dec. 27, 2016

(54) ANTI-MICROBIAL HEAT TRANSFER APPARATUS

(71) Applicant: Trane International Inc., Piscataway, NJ (US)

(72) Inventor: Thomas A. Ley, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 295 days.

(21) Appl. No.: 14/453,296

(22) Filed: Aug. 6, 2014

(65) Prior Publication Data

US 2015/0040601 A1 Feb. 12, 2015

Related U.S. Application Data

(60) Provisional application No. 61/862,727, filed on Aug. 6, 2013.

(51) Int. Cl.
*F28F 13/18* (2006.01)
*F28F 17/00* (2006.01)

(52) U.S. Cl.
CPC ..... *F28F 17/005* (2013.01)

(58) Field of Classification Search
CPC ..... F28F 17/005; F28F 13/18; F28F 19/02; F28F 2245/00; F28F 1/12; F28F 1/24; F28F 1/32; F28D 1/0417; F28D 1/047; F28D 1/05308; F28D 1/05316; F28D 1/05358; F28D 1/05366; F28D 1/04; F28D 1/10
USPC ... 165/133, 58, 60, 148, 150, 151, 152, 153, 165/900, DIG. 163, DIG. 172, DIG. 175
See application file for complete search history.

(56) References Cited

U.S. PATENT DOCUMENTS

| | | | | |
|---|---|---|---|---|
| 1,710,579 | A * | 4/1929 | Henshall | F28D 1/05333 165/151 |
| 3,246,691 | A * | 4/1966 | La Porle | F28D 1/05383 165/149 |
| 3,530,932 | A * | 9/1970 | Pryor | F28F 1/10 165/153 |
| 3,591,328 | A | 7/1971 | Szappanyos et al. | |
| 4,741,393 | A | 5/1988 | Collier | |
| 4,780,333 | A | 10/1988 | Smith et al. | |
| 5,014,774 | A | 5/1991 | Siak et al. | |
| 5,042,575 | A | 8/1991 | Lindsay | |
| 5,366,004 | A | 11/1994 | Garner et al. | |
| 5,529,807 | A | 6/1996 | Burkhart, Jr. et al. | |
| 5,639,464 | A | 6/1997 | Terry et al. | |
| 6,101,833 | A | 8/2000 | Suzuki | |
| 6,500,490 | B1 * | 12/2002 | Yan | B01J 29/04 427/343 |
| 6,705,391 | B1 | 3/2004 | Lewin | |

(Continued)

*Primary Examiner* — Justin Jonaitis
(74) *Attorney, Agent, or Firm* — Hamre, Schumann, Mueller & Larson, P.C.

(57) ABSTRACT

An anti-microbial heat transfer apparatus comprises a hybrid coil with multiple rows of fins and tubes. The fins and tubes have an upper portion and a lower portion. The upper portion comprises fins that include copper and has a height that is different than the height of the second portion. A chilled medium inside the tubes makes the surface of the fins and tubes colder than the temperature of the dew point of the surrounding air such that a condensate is formed on the surface of the fins. Gravity causes the condensate to drip copper ions from the upper portion to the lower portion of the coil resulting in the inhibition of microbial growth on the coil.

19 Claims, 2 Drawing Sheets

(56) References Cited

U.S. PATENT DOCUMENTS

| | | | | |
|---|---|---|---|---|
| 8,631,859 | B1 * | 1/2014 | Hettrich | F28F 9/0226 165/144 |
| 2010/0254081 | A1 * | 10/2010 | Koenig | F28D 1/05375 361/679.46 |
| 2011/0171373 | A1 | 7/2011 | Lee et al. | |
| 2014/0138236 | A1 * | 5/2014 | White | B01D 5/0006 202/185.3 |
| 2016/0131445 | A1 * | 5/2016 | Kimata | F28D 21/00 165/134.1 |

* cited by examiner

ANTI-MICROBIAL HEAT TRANSFER APPARATUS

FIELD

The disclosure herein relates to heating, ventilation, and air-conditioning ("HVAC") systems, and more particularly to an anti-microbial hybrid heat transfer apparatus that uses copper fins in the upper portion of a coil in an air handler, for example, to inhibit microbial growth.

BACKGROUND

Wet coils in HVAC systems, such as cooling coils, are susceptible to microbial growth because the wet surface of such coils provides excellent conditions (food source, moisture, ideal temperatures and humidity) for micro-organisms to grow. The microbial growth on such coils may have a negative impact on the indoor air quality as spores are released into the air stream. In addition, the microbial growth can give the indoor air an unpleasant smell. If not cleaned, the microbial growth can eventually block off the surface of the coil resulting in inadequate air flow, coil carryover and poor air handler performance. Because of this, it is common practice to have to clean heat transfer coils periodically to prevent such growth.

SUMMARY

Cooling coils in an HVAC system may be constructed as a fin and tube type coil. Fin and tube coils are made by pushing copper or aluminum tubes through the fins such as aluminum fins. The tubes and fins are then fitted into a sheet metal enclosure. Chilled water or refrigerant travels through rows of tubing in the coil such that the coil surface temperature is below the dew point temperature of the air being cooled As the surrounding air flows over the coil, it comes in contact with the chilled fins and tubes. As this happens, moisture from the surrounding air condenses on the fins and tubes. Meanwhile the air that has passed through the coil is colder and drier than when it entered the coil. The condensate on the coil eventually flows or drips down the fin surfaces into a drainage pan located underneath the coil. The moisture collected on the fins and tubes attracts microbial growth which can have a negative impact on air quality and the efficiency of the air conditioning unit. A build-up of microbial growth can block the surface of the coil resulting in coil carryover (also referred to as moisture carryover or carryover) e.g., when moisture is blown off of the surface of the coil by the kinetic energy of an air stream, which can damage downstream components and create unit water leakage issues. Additionally performance or face velocity limits can be de-rated by these blockages. Face velocity limits can be the maximum amount of air velocity over the coil before moisture is caused to blow off the coil. The higher the face velocity limit, the more air can flow through a coil without causing moisture to blow off the coil. Described herein is a hybrid coil for killing microbial growth as part of an HVAC system for residential, commercial and industrial cooling. In particular, this invention comprises a coil in which the upper portion of the coil uses copper fins, and a lower portion does not include copper.

A number of means have been used to prevent such microbial growth on heat transfer coils, such as UV light treatment, copper coils and biocide coatings. However, such means are not ideal. UV lights consume energy, require maintenance, and are expensive. Copper coils are more expensive than common aluminum coils and tend to be hydrophobic such that they may require derated face velocities to prevent carryover. Biocides are not robust and must be reapplied to be effective.

Although copper finned coils are well-known for their anti-microbial properties and excellent corrosive resistance, copper finned coils are twice as expensive as aluminum finned coils. Moreover, copper tends to be hydrophobic such that water on the copper fins does not disperse as easily which can result in coil carryover and lower face velocity limits. Aluminum finned coils, on the other hand, tend to be hydrophilic which results in improved condensate drainage off the fins and higher face velocity limits which makes them more cost effective at cooling than copper finned coils.

A hybrid coil made out of a mix of copper and aluminum fins is described wherein the copper fins are on the upper portion of the coil and the fins on the lower portion of the coil do not include copper and may be made of aluminum.

In one embodiment, multiple rows of fins and tubes are divided into an upper portion having a first height and a lower portion having a second height. The multiple rows of fins in the first portion include copper whereas the multiple rows of fins in the lower portion are made of aluminum. As condensate forms on the upper portion, copper ions from the copper fins develop in the condensate. The copper ions in the condensate travel or migrate from the upper portion to the lower portion of the hybrid coil by a means such as gravity. As the condensate travels, the copper ions in the condensate kill microorganisms attempting to grow on the aluminum fins and tubes in the lower portion of the hybrid coil. The amount of copper needed determines the height of the upper portion. The height of the upper portion is determined (at least in part) by how much condensate is needed to transfer copper ions from the upper portion of the coil to the lower portion of the coil to inhibit microbial growth on the lower portion of the hybrid coil, while also factoring in face velocity and coil carryover. The amount of copper used is at least partially determined by the size (height) of the coil relative to the size (height) of the aluminum fins to copper fins. In one example, the height of the upper portion of the hybrid coil is the larger of a minimum value (e.g. about 1.5-3.0") or a percentage of the entire hybrid coil height (~10%). Herein, reference to the coil height or entire or total coil height can refer to the total height of the heat transfer apparatus or to the total height of the upper portion and lower portion of fins, which may also be referred to as the finned height. In another embodiment, the height of H1 is about 25% of total height of the hybrid coil. However, the height of the upper portion is not limited to a particular height and can be any height that is capable of generating enough copper ions in the condensate to eliminate microbial growth on the lower portion of the hybrid coil without having to de rate the face velocity of the hybrid coil. Other factors to determine the height of the upper portion relative to the lower portion may include air quality and how much humidity is in the air. The hybrid coil design allows for the minimal use of copper fins to kill micro-organisms on the entire hybrid coil while at the same time using aluminum fins to maintain a higher face velocity limit and lower coil carryover than if the coil was made entirely of copper fins.

In general, face velocity issues are less of a concern at the top portion of the coil versus the lower part or the coil. Because there is little or no drainage from the fins above them, the fins on the upper portion typically have a lighter condensate load than the fins on the lower portion. Therefore, using copper fins only in the upper portion of the coil has less impact on the overall face velocity limit of the coil than if copper fins were used in the lower portion of the coil. As a result, the use of copper fins in the upper portion of the coil is unlikely to de-rate the coil for maximum air velocity. The maximum face velocity of the hybrid copper finned coil can be roughly equivalent to a full aluminum finned coil. Depending on how much copper is present on the coil and the effectiveness of the copper ions in killing micro-organisms, the hybrid copper finned coils can also kill micro-organisms in the drain pan.

In another embodiment, instead of using copper fins in the first portion of the coil, the fins in the first portion are made of aluminum and coated with a layer of copper.

In another embodiment, the hybrid coil comprises copper fins on about the top ⅓ of the coil while the remaining about ⅔ of the coil is made of aluminum fins.

In another embodiment, instead of using copper fins on about the top ⅓ of the coil, the top about ⅓ of fins are made of aluminum and coated with a layer of copper.

In another embodiment, the hybrid coil comprises copper fins on about the top ¼ of the coil while the remaining about ¾ of the coil is made of aluminum fins.

In another embodiment, instead of using copper fins on about the top ¼ of the coil, the top about ¼ of fins are made of aluminum and coated with copper.

BRIEF DESCRIPTION OF THE DRAWINGS

These and other features, aspects, and advantages of anti-microbial heat transfer apparatus, system and method will become better understood when the following detailed description is read with reference to the accompanying drawing, wherein.

While the above-identified drawing figures set forth particular embodiments of the anti-microbial heat transfer apparatus, system and method, other embodiments are also contemplated, as noted in the discussion. In all cases, this disclosure presents illustrated embodiments of the anti-microbial apparatus, system and method by way of representation and not limitation. Numerous other modifications and embodiments can be devised by those skilled in the art which fall within the scope of the principles of the anti-microbial apparatus, system and method described herein.

DETAILED DESCRIPTION

Figure 1:
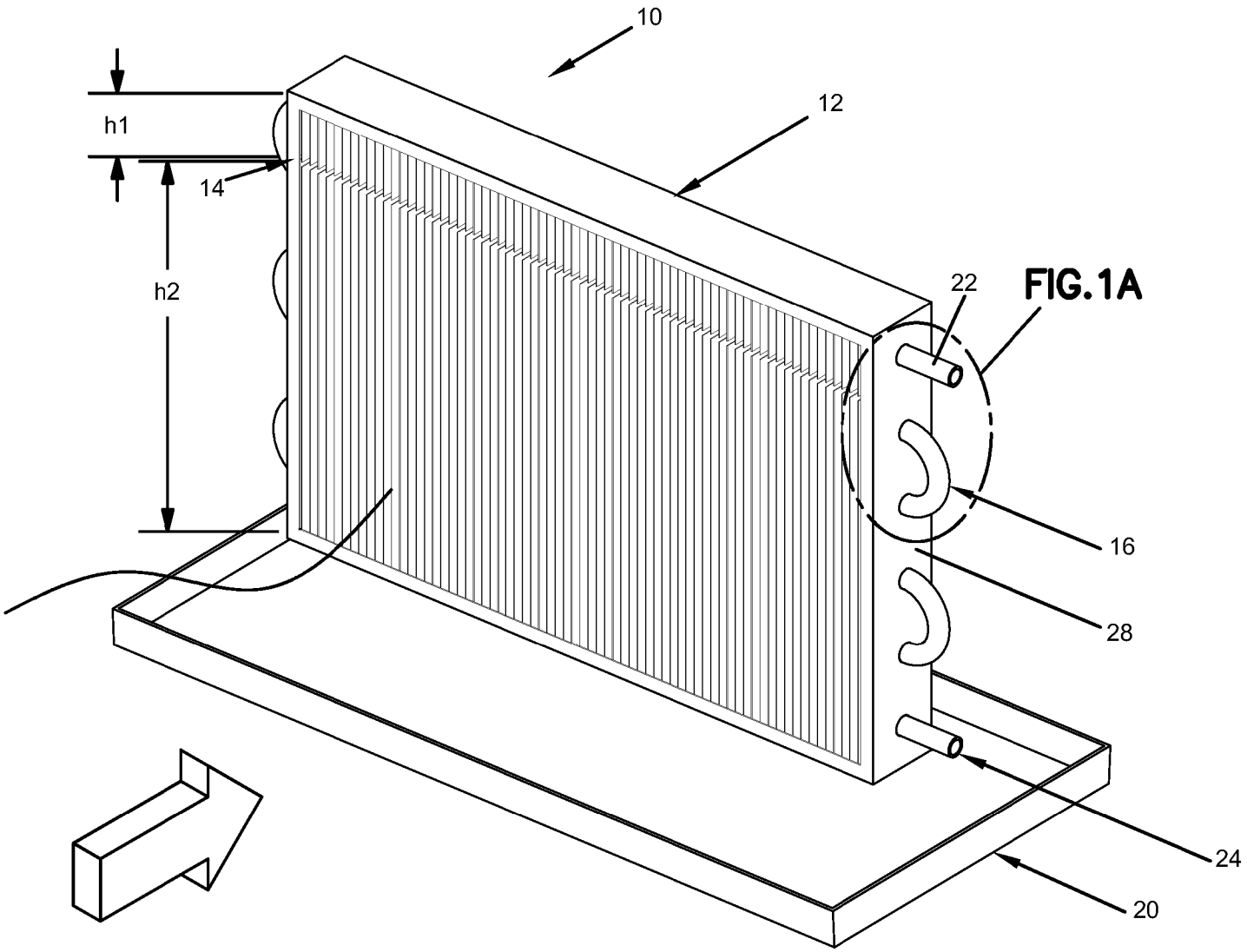
FIG. 1 is a perspective view of one embodiment of a hybrid coil.
Figure 1A:
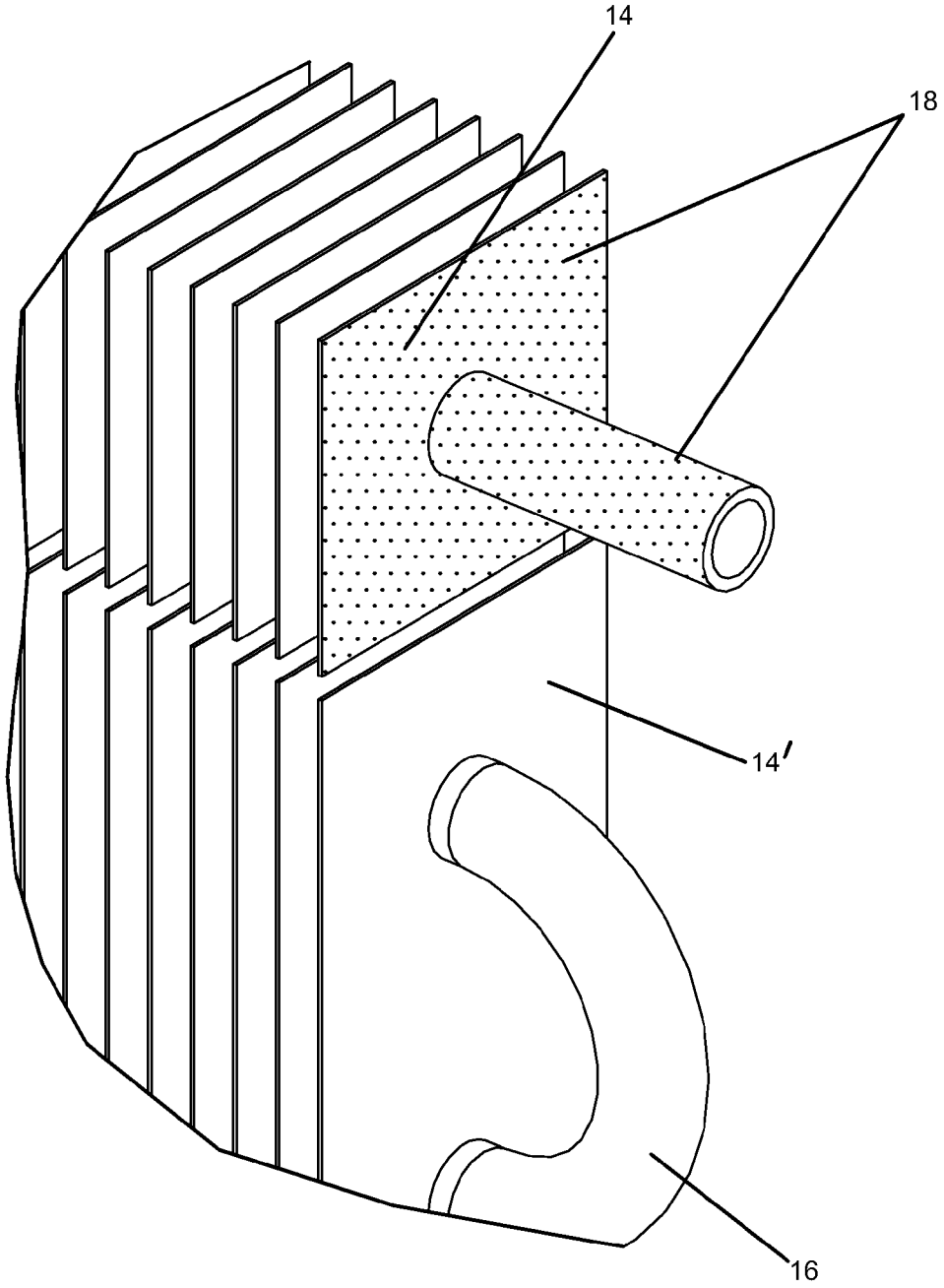
FIG. 1A is a close-up view of a partial cross-section A of FIG. 1

The basic design of a hybrid copper anti-microbial heat transfer apparatus 10 is shown in FIGS. 1 and 1A. The anti-microbial heat apparatus comprises a coil 12 having multiple rows of tubes 16. The tubes are surrounded by multiple rows of fins 14. This coil arrangement is known as a fin and tube coil. The hybrid coils used in this invention are typically oriented vertically and may be used in indoor cooling systems. They may also be oriented in various configurations, such as an A coil, V coil or slant configuration. Typically fin and tube type hybrid coils have between one and twelve rows of tubes. Although fin and tube heat exchangers may have any number of rows of tubes as long as the heat exchanger has fins including copper that are capable of generating a suitable amount of copper ions and condensate to inhibit microbial growth on the aluminum fins. The hybrid coils can vary in width, length and height in order to address various performance requirements. Although fin and tube hybrid coils may come in different shapes and sizes, the basic concept shown in FIG. 1 remains the same. The tubes 16 have an entry 22 and an exit 24 for a fluid such as for example chilled water or refrigerant to travel through the tubes. A chilled medium such as water or refrigerant can be carried through the coil inside the rows of tubes 16 so that the chilled tubes 16 and fins 14 are at a temperature that is lower than the dew point temperature of the surrounding air. As the surrounding air passes over the tubes and fins, water from the air forms a condensate 18 on the surface of the tubes and fins. The condensate 18 can be shown in FIG. 1A which is a close-up of cross-section A of the fins and tubes inside the coil in FIG. 1. The air that leaves the coil is at a lower temperature and humidity than it was before it entered the coil. Because coils cool the air, they are sometimes referred to as cooling coils. The condensate 18 that collects on the hybrid coil travels such as by gravity over the fins and tubes into a drain pan 20, and ultimately down a condensate drain line.

To form the hybrid coil, multiple rows of tubes 16 are pushed into sheets of formed fins 14 and fit into a sheet metal enclosure 30. In one embodiment, the major lengthwise direction of the fins 14 runs substantially perpendicular to the major lengthwise direction of the tubes 16 such that the tubes run through the fins at about a 90 degree angle. However, the fins can be slanted at other angles as well. The tubes can be parallel or staggered to the airflow but the axis of the tubes may be perpendicular to the axis of the fins.

A supply header may be connected to the front 28 of the coil and can provide chilled water or refrigerant from e.g. a condensing unit (not shown) to the coil. The chilled water or refrigerant enters the coil through entry 22 and may fill a supply header/distributor. Thereafter, the liquid or refrigerant enters multiple rows of tubes 16 that may have openings to the liquid in the supply header. As the chilled liquid travels through the rows of tubes 16, it absorbs heat and moisture from the surrounding air. The water or refrigerant may exit the tubing into the return header and finally leaves the coil through exit 24 to travel for example to a chiller or compressor to continue the cooling cycle.

The coil is divided into an upper portion and a lower portion, the upper portion has a first height H1 and the second portion has a height H2. Height H1 and height H2 are measurements of the height of the fins in the upper portion and the lower portion respectively. The multiple fins in the upper portion of the coil include copper, a copper alloy or are coated in a layer of copper or copper alloy, or may be in whole or in part made of copper. FIG. 1A shows fins 14 from the upper-portion H1 on top of the fins 14' from the lower portion H2. In one embodiment the fins on the upper portion 14 and the fins on the lower portion 14' are lined up on top of one another other so that in some embodiments they may touch. In another embodiment, the upper and lower portions of fins are made out of the same piece of aluminum with the top portion coated with a layer of copper. For example, in the embodiment shown in FIG. 1, the fins in the upper and lower portions may be constructed out of the same piece of aluminum, wherein the fins in the upper portion are coated in copper. In another embodiment, the upper portion of fins and the lower portion of fins do not touch, but are close enough together so that condensate can be carried from the top portion of the fins to the lower portion of the fins. For example, one or more fins in the upper portion 14 may be lined up on top of one or more respective fins of the lower portion.

The amount of copper in the hybrid coil is determined by how many copper ions need to be generated by the fins in the first height H1 of the upper portion 14' in order for the condensate to carry enough copper ions to the fins in the lower portion H2 so as to prevent and kill microbial growth on the lower portion of the hybrid coil H2. The height of the upper portion is at least partly determined by how much condensate is needed to transfer copper ions from the upper portion of the hybrid coil to the lower portion of the hybrid coil to inhibit microbial growth on the lower portion of the coil, while also factoring in face velocity and coil carryover. In one example, the height of H1 is the larger of a minimum value (e.g. about 1.5-3.0") or a percentage of the entire hybrid coil (~10%) height. However, the height of H1 is not limited to a particular height and can be any height that is capable of generating enough copper ions in the condensate to eliminate microbial growth on the fins in lower portion H2 of the hybrid coil without having to de rate the face velocity of the coil. Therefore, given the potentially negative impact of copper fins on carryover, a minimal amount of copper is used in the fins in the upper portion H1 so as to generate copper ions suitable to inhibit microbial growth in the lower H2 portion of the hybrid coil, and while not having to de rate face velocities since aluminum fins are maintained. The height H1 and H2 of the upper and lower portions can change depending on the size, cooling capacity and expected microbial loading of the hybrid coil. Other factors to determine the height of H1 relative to H2 in the hybrid coil may include air quality (e.g. dust) and the humidity in the air. The upper portion H1 contains at least one tube. The orientation of the hybrid coil can be vertical or angled so that gravity can pull condensate from the upper portion H1 to the lower portion of the hybrid coil H2. However, the angle of the hybrid coil could be for example no more than about 45 degrees form vertical.

Because copper is expensive, hydrophobic in nature and has a lower face velocity than other materials such as aluminum, the amount of copper used in the upper portion can be configured to be at a minimum amount necessary to have suitable migration of copper ions to prevent and kill micro-organism growth on the lower portion of the hybrid coil while at the same time reduce or eliminate the need to de-rate the face velocity of the hybrid coil. For example, the upper portion of the hybrid coil can be configured so that it has a suitable amount of copper available and so that when enough condensate is generated, copper ions can be carried or migrate down the hybrid coil while at the same time maintaining minimal moisture carryover. H1 and H2 can be sized so that about 75-95% of the fin material is made of aluminum while the remaining about 5-25% of fin material is made of copper.

In order to determine the proper height of H1, a number of factors may be considered. One consideration can be the surface area of the hybrid coil. The fin surface area of the hybrid coil can be at least partly determined by the number of fins and their size. Typically the more fins per foot, the greater surface area of the hybrid coil. Spacing the fins closer together multiplies the surface area by permitting more fins per foot. The spacing of fins in a typical cooling coil for residential and commercial use is about 144 fins/ft. However, the spacing of fins in the hybrid coils can range anywhere from approximately 70 fins/ft. to 230 fins/ft. Adding rows of tubes also increases the heat-transfer surface area. Face velocity can also be reduced by increasing the size of the hybrid coil and/or by reducing the required airflow. The more fins per foot, the lower the face velocity limit of the hybrid coil. For example, a coil having 180 fins/ft. has a lower face velocity limit than a hybrid coil having 144 fins/ft.

Another consideration to determine the proper height of H1 can be the amount of air flow needed to flow across the coils to generate enough condensate to carry copper ions to the lower portion of the hybrid coil to inhibit microbial growth. A residential or commercial air conditioner can range from about 200 Cubic Feet per Minute ("CFM") which is equivalent to about 0.5 tons to over 60,000 CFM which is equivalent to about 150 tons. Enough air is needed to blow over the hybrid coil to generate enough condensate to carry copper ions on the upper portion down the hybrid coil. In general, the CFM of a particular cooling coil may be pre-set according to cooling requirements. To achieve the right amount of copper ions, the height of H1 relative to H2 may need to be adjusted depending on the CFM of the particular hybrid coil. Other factors that may be considered include the thickness of the hybrid coil, the size, number and shape of the fins and tubes. Generally the tighter the fin spacing (higher fin series) the lower the face velocity limit. Also the thicker the coil (more rows) the lower the face velocity because more condensate is developed. Another factor to consider is the face velocity limit of the hybrid coil as mentioned above. The higher the velocity limit, the more air that can flow through the coil for the physical size of the hybrid coil without carryover of moisture. For example, the heating and cooling industry is familiar with the 500 feet/minute ("fpm") limit through a cooling coil to safeguard against moisture carryover. This is the industry rule of thumb for nominal velocity. However, aluminum fin designs may extend this limit in excess of 625 fpm depending upon air conditions, coil size, and coil-fin type, and fin spacing. Aluminum can have a face velocity limit that is about 75 fpm higher than the face velocity limit for copper. Other factors may be considered as well, when determining the height H1 of the first portion of the hybrid coil as compared to the height H2 of the second portion of the hybrid coil. However, the height H1 of the first portion in certain circumstances does not lessen the face velocity limit of the coil, but can also enable enough condensate to form on the upper portion so that copper ions travel down the hybrid coil and inhibit microbial growth.

The rows of multiple fins in the upper portion may be made out of copper, a copper alloy or be covered in a coating of copper. For example, the fins may be made out of aluminum and coated with copper. In order to determine the proper amount of copper for the fins, a base line may be established by running comparative tests on an all-aluminum coils, hybrid coils (5% to 25% copper) and all copper coils. The test is accelerated by running the air conditioning units 100% of the time with wet conditions and very high dirt loads to accelerate the process of microbial growth. Coil airside pressure drop is measured and visual observations are used to assess microbial buildup on each coil. Air samples and surface samples from each coil are used to assess CFU (Colony Forming units). Once the baselines are established, additional tests are run with partially wet copper coils tested against partially wet hybrid and aluminum coils to determine the effect of each type of coil on coil cleanliness. Different amounts of copper are used on the upper portion H1 of the coil to determine how much copper is needed to inhibit microbial growth while maintaining coil performance.

EXAMPLE 1

A cooling coil having 144 fins/ft. with coils in a 15,000 CFM air handling unit is formed comprising an upper and lower portion of tubes and fins. The unit coil has a finned height of 52.5" and a finned width of 82" with an overall area of 29.9 $ft^2$ and nominal face velocity of 502 fpm. The upper portion is about 12" in height (about 23% of finned height of the coil), the lower portion is about 40.5" in height (about 77% of the finned height of the coil). The rows of fins in the upper portion are made of copper. The fins on about the lower 77% are made of aluminum. In one embodiment, the lower portion of the fins may be coated for corrosion protection. The upper portion of copper fins generates enough copper ions to inhibit microbial growth on the lower portion of the coil. Enough air flows over the coil to generate enough condensate to carry copper ion down the coil. In one embodiment, a coil having a face velocity 500 fpm has enough air flow over the coil to generate enough condensate to carry copper ions down the coil. The coil can also maintain the same face velocity limit as if the whole coil were made of aluminum, coated or uncoated. In one embodiment, the hybrid coil maintains a face velocity limit of 500 fpm.

EXAMPLE 2

A hybrid coil having 144 fins/ft. with coils in a 1200 CFM blower coil unit is formed comprising an upper and lower portion of tubes and fins. The unit coil has a finned height of 12" and finned width of 36". The upper portion is about ¼ the height of the finned height (about 3"). The lower portion is about ¾ the finned height (about 9"). The rows of fins in the upper portion are made of copper. The fins on about the lower ¾ are made of aluminum. The upper portion of copper fins generates enough copper ions to inhibit microbial growth on the lower portion of the hybrid coil. In one embodiment, a hybrid coil having a face velocity 500 fpm has enough air flow over the coil to generate enough condensate to carry copper ions down the hybrid coil. The hybrid coil can also maintain the same face velocity limit as if the whole coil were made of aluminum, coated or uncoated. In one embodiment the hybrid coil maintains a face velocity limit of 500 fpm.

EXAMPLE 3

A hybrid coil having 144 fins/ft. with coils in a 75,000 CFM air handling unit is formed comprising an upper and lower portion of tubes and fins. The unit has two coils with finned heights of 51" and finned widths of 168", with an overall area of 119 $ft^2$ and a nominal face velocity of 630 fpm. The upper portion of each coil is 6" about 12% total finned height. The lower portion is about 45" about 88% total finned height. The rows of fins in the upper portion are about 6 "in height and are made of copper. The fins in the lower portion are made of aluminum. The upper portion of copper fins generates enough copper ions to inhibit microbial growth on the lower portion of the hybrid coil. In one embodiment, a hybrid coil having a face velocity 630 fpm has enough air flow over the coil to generate enough condensate to carry copper ions down the coil. The hybrid coil can also maintain the same face velocity limit as if the whole coil were made of aluminum, coated or uncoated. In one embodiment the hybrid coil maintains a face velocity limit of 630 fpm.

EXAMPLE 4

A hybrid coil having 144 fins/ft. with coils in a 400 CFM fan coil unit is formed comprising an upper and lower portion of tubes and fins. The hybrid coil in this unit has a finned height of 8" and a finned width of 20", with an overall area of 1.1 $ft^2$ and nominal face velocity of 360 fpm. The upper portion is about ¼ the total finned height (about 2"). The lower portion is about ¾ the total finned height (about 6"). The rows of fins in the upper portion are coated in a thin layer of copper. The coating thickness can be no more than about 0.001" or at about 0.001". The overall fin thickness ranges from about 0.004" to 0.0075". The fins on about the lower portion are made of aluminum. The upper portion of copper coated fins generates enough copper ions to inhibit microbial growth on the lower portion of the hybrid coil. Under nominal conditions (e.g. an airflow rate of 500 fpm) enough air flows over the hybrid coil to generate enough condensate to carry copper ion down the coil. The hybrid coil can also maintain about the same face velocity limit as if the whole hybrid coil were made of aluminum, coated or uncoated or at least reduces the impact of using copper fins on the upper portion. In one embodiment the hybrid coil maintains a face velocity limit of 360 fpm.

The multiple rows of tubes 16 (e.g. tubes shown in the FIGS. 1-2) are sometimes referred to as a tube bundle. The multiple rows of tubes are typically made of copper, however the multiple rows of tubing can be made of other material such as brass so long the material does not inhibit the function of the heat transfer device.

In one embodiment the hybrid coil is an outdoor coil having an upper portion and a lower portion comprising fins and tubes. The upper portion has fins including copper. Rain water and/or condensate transfers copper ions from the upper portion to the lower portion of the hybrid coil. As sunlight is a natural killer of microorganisms, this type of hybrid coil may be useful for outdoor coils that are shielded from sunlight (UV).

It will be appreciated that any of aspects 1 to 4 may be combined with any of aspects 5 to 8. Aspect 5 may be combined with any of aspects 6 to 8. Aspect 6 may be combined with any of aspects 7 to 8. Aspect 7 may be combined with aspect 8.

Aspect 1. An anti-microbial heat transfer apparatus comprising: a hybrid coil having multiple rows of fins and tubes, the fins and tubes being divided into an upper portion and a lower portion, the upper portion further comprising fins made out of copper and having a first height and the second portion having a second height; a chilled liquid inside the tubes making the surface of the fins and tubes colder than the temperature of the dew point of the surrounding air such that a condensate is formed on the surface of the fins, wherein gravity causes the condensate to drip copper ions from the upper portion to the lower portion of the coil and; wherein the first height of the upper portion is less than the second height of the second portion determined by how much condensate is needed to transfer enough copper ions from the upper portion to the lower portion of the coil to kill and/or inhibit microbial growth on the lower portion of the coil.

Aspect 2. The anti-microbial heat transfer apparatus of claim 1 wherein the fins in the upper portion are coated in copper.

Aspect 3. The anti-microbial hybrid heat transfer apparatus of claim 1 wherein the height of the upper portion is ⅓ of the height of the coil and the height of the lower portion is ⅔ the height of the coil.

Aspect 4. The anti-microbial hybrid heat transfer apparatus of claim 1 wherein the height of the upper portion is ¼ the height of the coil and the height of the lower portion is ¾ the height of the coil.

Aspect 5. A method of killing and/or inhibiting microbial growth on a heat transfer apparatus, comprising: directing a chilled medium through a hybrid coil having multiple rows of fins and tubes, the rows of fins being divided into an upper portion and a lower portion wherein the upper portion includes copper; chilling the surface of the fins to a temperature lower than the dew point temperature of the surrounding air; blowing the surrounding air over the hybrid coil to create a condensate on the surface of the upper and lower portion of fins; capturing copper ions in the condensate on the upper portion of fins; and allowing the copper ions in the condensate to travel down the hybrid coil from the upper portion to the lower portion to kill and/or inhibit microbial growth on the lower portion of the hybrid coil.

Aspect 6. A refrigeration system for killing and/or inhibiting microbial growth on a heat transfer apparatus comprising: a hybrid coil having multiple rows of tubes and fins, the fins further divided into an upper portion and a lower portion, the upper portion having a first height and the lower portion having a second height wherein the upper portion includes copper; a chilled medium to flow through the tubes to make the surface of the fins colder than the dew point temperature of the surrounding air, such that a condensate forms on the surface of the fins; copper ions on the upper portion are captured in the condensate; wherein the first height of the upper portion is less than the second height of the second portion determined by how much condensate is needed to transfer enough copper ions from the upper portion to the lower portion of the coil to inhibit microbial growth on the lower portion of the hybrid coil.

Aspect 7. An anti-microbial hybrid heat transfer apparatus comprising: a hybrid coil comprising multiple rows of tubing having an entry and an exit and multiple rows of fins surrounding the multiple rows of tubing wherein about the top ¼ rows of fins include copper and about the lower ¾ rows of fins include aluminum; a drainage pan below the hybrid coil; and a supply header connected to the entry of the tubing and an return header connected to the exit of the header to allow a chilled liquid to pass through the tubing within the coil; the chilled liquid inside the tubing making the surface of the fins and tubes colder than the temperature of the dew point of the surrounding air such that a condensate is formed on the surface of the tubes and fins, wherein the condensate carries copper ions from the copper fins as gravity causes it to drip down the coil in order to kill and/or inhibit microbial material that has formed on the fins and tubes and drainage pan.

Aspect 8. An anti-microbial heat transfer apparatus comprising: an outdoor hybrid coil having multiple rows of fins and tubes, the fins and tubes being divided into an upper portion and a lower portion, the upper portion further comprising fins including copper and having a first height and the second portion having a second height; and a surface of the upper portion of the fins being exposed to rainwater, wherein gravity causes the rainwater to carry copper ions from the upper portion to the lower portion of the coil; wherein the height of the upper portion is determined by how much many upper portion fins need be exposed to rainwater to transfer enough copper ions from the upper portion to the lower portion of the coil to inhibit microbial growth on the lower portion of the hybrid coil.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

The invention claimed is:

1. An anti-microbial heat transfer apparatus comprising:

a hybrid coil having multiple rows of fins and tubes, the fins and tubes being divided into an upper portion and a lower portion, the fins of the upper portion including copper and having a first height and the lower portion having a second height;

inside the tubes a chilled medium flows therethrough to cool a surface of the fins and tubes to be colder than a dew point temperature of surrounding air such that when air flows across the hybrid coil, condensate is formed on the surface of the fins, wherein gravity causes the condensate to drip copper ions from the fins of the upper portion to the lower portion of the coil and;

wherein the first height of the upper portion is less than the second height of the lower portion, which is determined by an amount of condensate needed to transfer a suitable amount of copper ions from the upper portion to the lower portion of the hybrid coil to kill and/or inhibit microbial growth on the lower portion of the hybrid coil.

2. The anti-microbial heat transfer apparatus of claim 1 wherein the fins in the upper portion are coated with copper or made of copper.

3. The anti-microbial hybrid heat transfer apparatus of claim 1 wherein the first height of the upper portion is ⅓ of the height of the hybrid coil and the second height of the lower portion is ⅔ the height of the hybrid coil.

4. The anti-microbial hybrid heat transfer apparatus of claim 1 wherein the coil comprises 1 to 12 rows of tubes.

5. The anti-microbial hybrid heat transfer apparatus of claim 1 wherein the coils are oriented vertically or slanted or arranged in an A coil or V coil configuration.

6. The anti-microbial hybrid heat transfer apparatus of claim 1 wherein the chilled liquid is a refrigerant.

7. The anti-microbial hybrid heat transfer apparatus of claim 1 wherein the hybrid coil further comprises a fin spacing of about 70 fins/ft. to about 230 fins/ft.

8. The anti-microbial hybrid heat transfer apparatus of claim 1 wherein the fins comprise a material including at least 5% copper.

9. The anti-microbial hybrid heat transfer apparatus of claim 1 wherein thickness of the fins is about 0.0075" or less.

10. The anti-microbial hybrid heat transfer apparatus of claim 1 wherein one or more of the fins in the upper portion line-up on top of one or more respective fins in the lower portion.

11. The anti-microbial heat transfer apparatus of claim 1 wherein one or more fins in the upper portion line-up of and touch one or more respective fins in the lower portion.

12. The anti-microbial hybrid heat transfer apparatus of claim 1 wherein one or more of the fins is constructed of a single piece of aluminum wherein the upper portion is coated with copper.

13. The anti-microbial heat transfer apparatus of claim 12 wherein the thickness of the layer of copper coating is about 0.001" or less.

14. The anti-microbial heat transfer apparatus of claim 1 wherein the first height of the upper portion is about 10% or more of the height of the hybrid coil.

15. The anti-microbial heat transfer apparatus of claim 1 wherein the first height of the upper portion is about 1.5" to about 3".

16. A method of killing and/or inhibiting microbial growth on a heat transfer apparatus, comprising:

directing a chilled medium through a coil having multiple rows of fins and tubes, the rows of fins being divided into an upper portion and a lower portion wherein the upper portion includes copper;

chilling the surface of the fins to a temperature lower than the dew point of the surrounding air;

blowing the surrounding air over the coil to create a condensate on the surface of the upper and lower portion of fins;

capturing copper ions in the condensate on the upper portion of fins; and allowing the copper ions in the condensate to travel down the coil from the upper portion to the lower portion to kill and/or inhibit microbial growth on the lower portion of the coil.

17. The method of claim 16 wherein one or more of the blowing, capturing or transferring steps is performed with the upper portion being about 10% the height of the hybrid coil, air speeds of about 200 CFM or more, and the coils having a fin spacing of about 70 fins/ft. to about 230 fins/ft.

18. The method of claim 16 wherein one or more of the blowing, capturing or transferring steps is performed with the fins of the upper portion coated in copper.

19. An anti-microbial heat transfer apparatus comprising:

a hybrid coil having multiple rows of fins and multiple rows of tubes having an entry and an exit, the fins and tubes being divided into an upper portion and a lower portion, the fins of the upper portion including copper and having a first height and the fins of the lower portion including aluminum and have a second height;

one or more respective fins of the upper portion line-up on top of one or more respective fins of the lower portion;

a drain pan located below the hybrid coil;

a supply header connected to the entry of the tubes and a return header connected to the exit of the tubes;

inside the tubes a chilled medium flows therethrough to cool a surface of the fins and tubes to be colder than a dew point temperature of surrounding air such that when air flows across the hybrid coil, a condensate is formed on the surface of the fins, wherein gravity causes the condensate to drip copper ions from the fins of the upper portion to the lower portion of the coil and into the drain pan and;

wherein the coil is configured to have a fin spacing of about 70 fins/ft. to about 230fins/ft. and the first height of the upper portion comprises 10% or more the height of the hybrid coil, and in the presence of face velocities of about 360 fpm or more and air speeds of about 200 CFM or more, the condensate generated under such conditions transfers a suitable amount of copper ions from the fins of the upper portion to the lower portion of the hybrid coil to kill and/or inhibit microbial growth on the lower portion of the coil and drain pan so as to avoid de rating face velocity limits or avoid increasing coil carryover of the heat transfer apparatus.

* * * * *